United States Patent [19]

Duerr

[11] Patent Number: 4,770,218

[45] Date of Patent: Sep. 13, 1988

[54] BLOCK STRIPPER AND STROKE STOP FOR WOOD SPLITTERS

[76] Inventor: Dennis Duerr, Rt. 1, Box 144, E. 12122 Day Mt. Spokane Rd., Mead, Wash. 99021

[21] Appl. No.: 146,971

[22] Filed: Jan. 22, 1988

[51] Int. Cl.[4] ..... B27L 7/00

[52] U.S. Cl. ..... 144/193 A; 83/146; 144/366

[58] Field of Search ..... 83/145, 146; 144/193 R, 144/193 A, 366

[56] References Cited

U.S. PATENT DOCUMENTS

| | | | |
|---|---|---|---|
| 2,851,072 | 9/1958 | Gerjets et al. | 144/193 A |
| 3,779,295 | 12/1973 | Balsbaugh | 144/193 A |
| 4,275,779 | 6/1981 | Rowe | 144/193 A |
| 4,444,231 | 4/1984 | Dillon | 144/193 A |
| 4,700,759 | 10/1987 | Duerr | 144/193 A |

OTHER PUBLICATIONS

"Lickity Log Splitter", Brochure, Piqua Engineering.

Duerr Brochure, Jul. 1, 1985.

"Lickity Log Splitter", Owner's Manual, pp. 3,12,23,24.

*Primary Examiner*—W. Donald Bray

*Attorney, Agent, or Firm*—Wells, St. John & Roberts

[57] ABSTRACT

A block stripper and stroke limiting is described for use in wood splitters in which a blade is driven by toward and away from a stationary wood support surface. The attachment includes a stop that can be selectively positioned along the splitter frame to abut operatively with the blade as it is withdrawn from its fully extended position. A new blade starting position may be determined by selectively positioning the stop along the frame and by securing the stop to engage and resist retraction of the blade beyond the newly selected starting position. A wood stripping device is mounted to the stop and is adjustable therewith to selected positions along the splitter frame. The stripper will operate at any position along the stroke length of the cylinder to strip bound, partially-split wood from the splitting blade as it is retracted to the selected starting position.

10 Claims, 5 Drawing Sheets

BLOCK STRIPPER AND STROKE STOP FOR WOOD SPLITTERS

TECHNICAL FIELD

The present invention relates to a powered wood splitters and especially to apparatus for stripping wood from the blade of the splitter and for selectively limiting the stroke of the splitting blade.

BACKGROUND OF THE INVENTION

Powered wood splitters are a boon to both professionals and weekend wood gatherers. Powered splitters greatly reduce the amount of time and effort required to split large wood blocks into more manageable size split pieces. Even so, conventional powered splitters are not without certain problems that detract from full efficiency and utility.

A first problem associated with splitters is the effective stroke length of the splitting blade. The stroke length for a splitter blade must be greater than the longest wood block to be split; splitters are therefore made with a relatively long stroke capacity for long blocks. The problem comes in the time required to complete the stroke when shorter blocks are to be split. Valuable time is wasted as the blade is moved from its beginning position into contact with a short block. Similarly, time is wasted when the blade is retracted to its beginning position after splitting the wood.

Stroke limiting apparatus have been developed as a solution to the above problem. For example, a wood splitter developed by Piqua Engineering, Inc. of Piqua, Iowa includes a ram return stop that is selectively adjustable along the frame of the splitting device for limiting the retracted position of a one-way ram cylinder. The return stop bar may be adjustably positioned in the path of the retracting ram to stop the ram at a desired position, thereby effectively adjusting the length of stroke. The cylinder involved is a "single acting" cylinder in which the return stroke of the ram is effected by a spring and cable mechanism. The ram is not hydraulically powered to return to its starting position but is instead returned by spring force. The stop is effective in this construction to prevent retraction of the ram simply by overcoming the relatively light spring tension used to pull the ram back to its starting position.

U.S. Pat. No. 2,851,072 to Gergets et al. discloses a wood splitting machine having a valve actuator mechanism that will effectively change the starting position of a movable platform. Here, a double acting hydraulic cylinder is provided and an arm is mounted to a movable platform connected to the cylinder for selectively contacting a valve actuator. The arm is positioned to actuate the valve at different retracted positions for the platform, thereby effectively adjusting the stroke length. This device effectively controls the positioning for the platform in conjunction with a double acting hydraulic cylinder. However, it requires very specific placement of the actuator valve in relation to the trip mechanism on the platform. Furthermore, adjustment is capable only within a range dictated by the swing path of the pivoted actuator bar.

U.S. Pat. No. 3,779,295 to Balsbaugh also discloses a stroke controlling arrangement by which a control rod is connected to a manual stroke control lever. The lever is connected to an actuator valve for selectively directing fluid to a double acting hydraulic cylinder. Collars on the control rod at opposite ends of a predetermined stroke length are engaged by a slider on the splitting blade carriage.

Another problem with powered wood splitters is that few provide mechanism by which wood can be stripped from a jammed position on the splitting blade. In the Balsbaugh patent a pivoted rod can be swung into position to abut a wood block jammed on the splitting wedge as the wedge reaches its fully retracted position. A stripping mechanism is disclosed in my prior U.S. Pat. No. 4,700,759 that functions to separate wood from the splitting head as the splitting head reaches its fully retracted position. This device includes the additional advantage of protecting the user's fingers by enclosing the blade within the stripping mechanism as it is lowered to the surface of the wood. However, the stripping function occurs only at the full retracted position of the blade.

Other stripping arrangements have been available in the past. For example, I have produced an earlier splitter form that includes a fixed stripping device that is affixed to the splitter frame and is positioned along the frame to strip wood from the splitting blade as the blade reaches its fully retracted position.

Of the above stripping mechanisms, none enable stripping of wood at any selected position along the length of the splitter frame. All require nearly full retraction of the splitter blade or wood support to complete the stripping function.

It therefore has remained a problem to obtain efficiency in wood splitters by adjusting the stroke length to accommodate wood of different length dimensions and for stripping wood from a blade that is selectively positioned for shorter stroke length on the frame.

BRIEF DESCRIPTION OF THE DRAWINGS

A preferred embodiment of the invention is illustrated in the accompanying drawings, in which.

DETAILED DESCRIPTION OF THE PREFERRED EMBODIMENT

Figure 1:
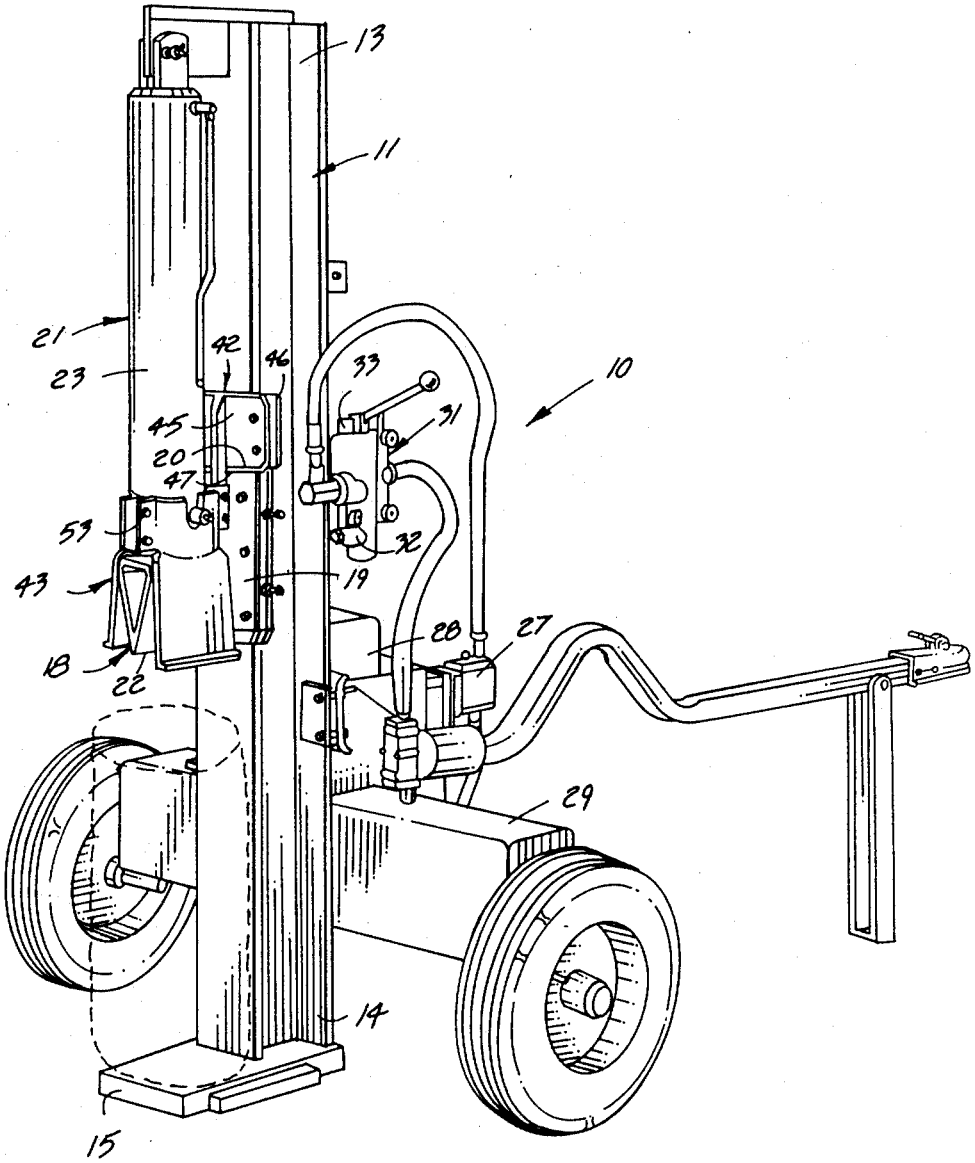
FIG. 1 is a pictorial view of a wood splitter including stroke limiting and wood stripping features of the present invention.
Figure 2:
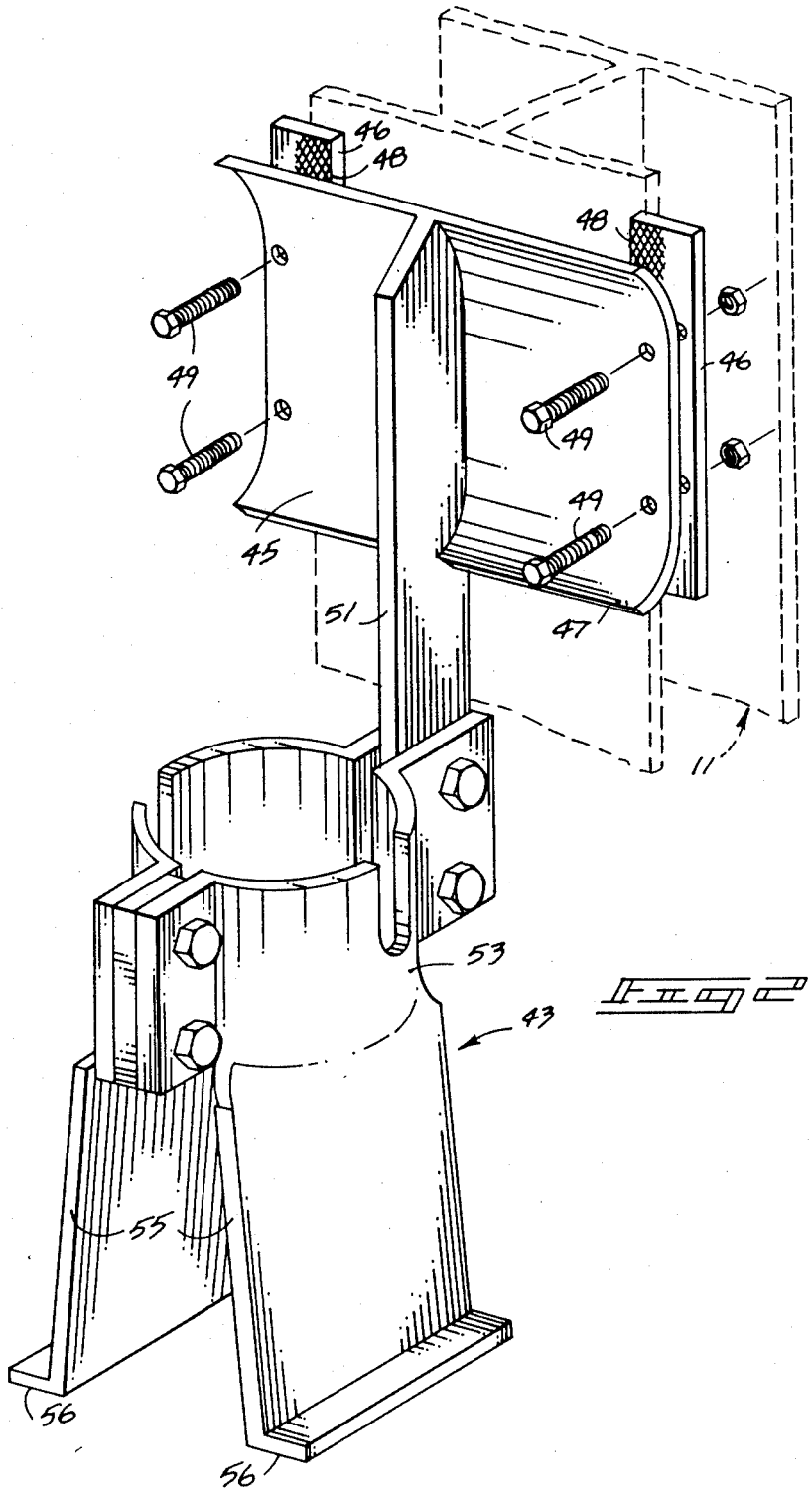
FIG. 2 is a detailed view of the present stroke stop and stripping attachment.
Figure 3:
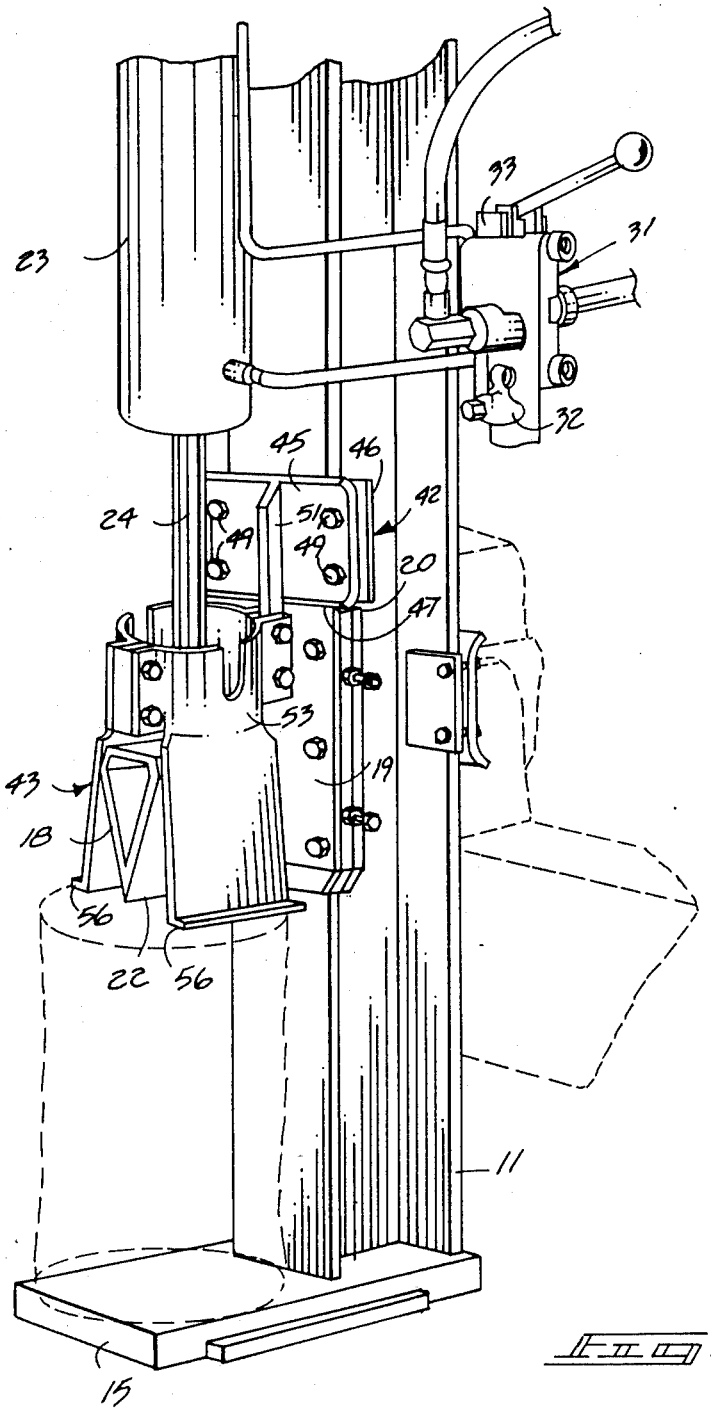
FIG. 3 is a view similar to FIG. 1 only showing an operative position limiting the stroke for an associated splitting blade.
Figure 4:
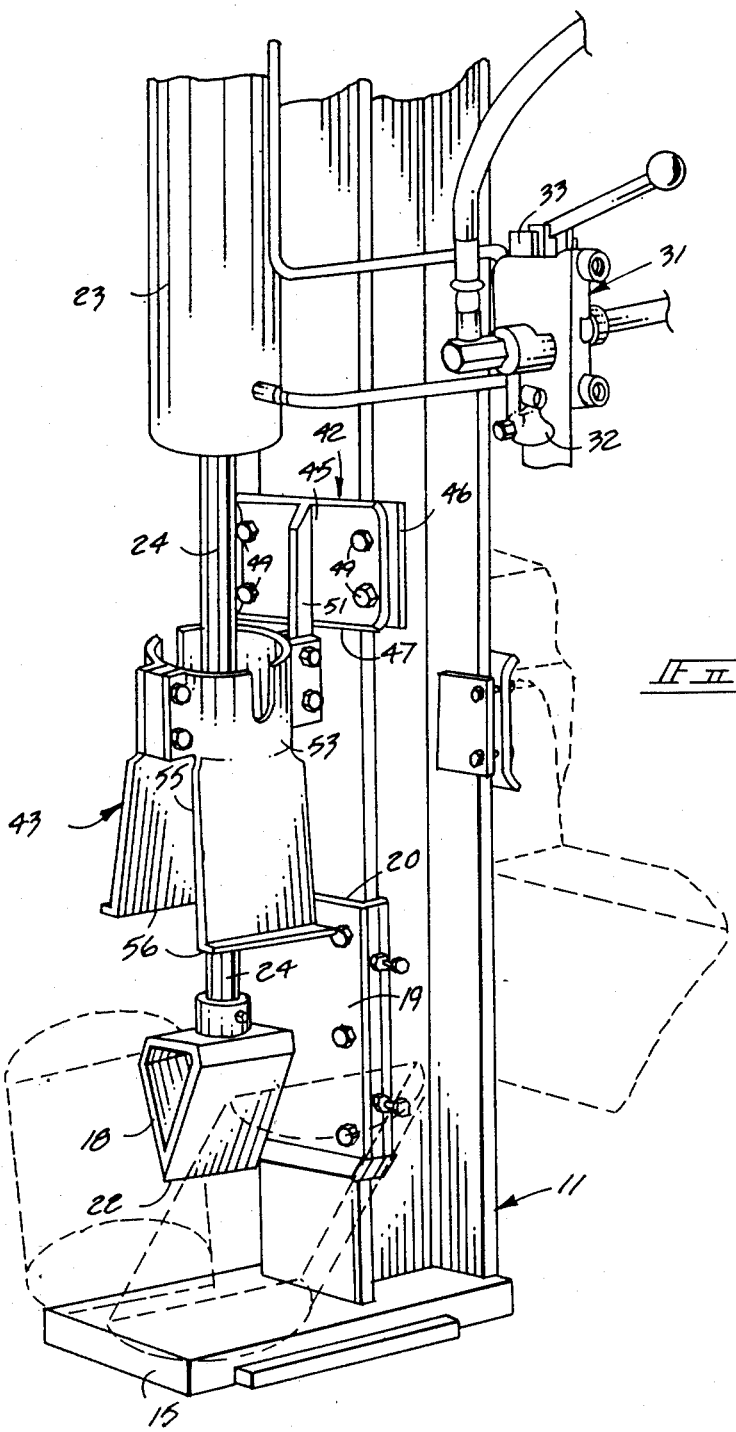
FIG. 4 is a view similar to FIG. 3 only showing the splitting blade in an extended position.

The following disclosure of the invention is submitted in compliance with the constitutional purpose of the Patent Laws "to promote the progress of science and useful arts" (Article 1, Section 8).

A wood splitter including features of the present invention is generally shown at 10 in the accompanying drawings. The wood splitter 10 incorporates an elongated rigid frame 11 that may be constructed of an I-beam or other rigid metal configuration extending between a top end 13 and a bottom end 14. A wood support 15 is rigidly attached to the frame 11 at the bottom end 14.

A splitting blade 18 having a downward cutting edge 22 is movably mounted to the frame 11. The splitting blade 18 is carried by a support slide plate 19. Plate 19 is slidably mounted to the frame 11 for movement toward and away from the wood support 15. A top edge 20 of the slide plate faces upwardly and spans the width of the frame 11.

A drive means 21 is provided for selectively moving the splitting blade from a starting position through a splitting stroke toward the wood support 15 and a retraction stroke back to the starting position. Drive means 21 preferably includes a double acting hydraulic cylinder 23 attached to the frame 11. Cylinder 23 includes an elongated piston shaft 24 that is mounted at an end thereof to the splitting blade 18. The cylinder 23 is a double acting cylinder. That is, the cylinder is powered by hydraulic fluid under pressure to extend and retract the piston shaft 24.

Hydraulic fluid is supplied to the cylinder 23 by means of a pump 27 driven by a power source such as an engine 28. Hydraulic fluid is supplied to the pump and cylinder through a reservoir 29 by means of conventional hydraulic hose and line connections.

Figure 5:
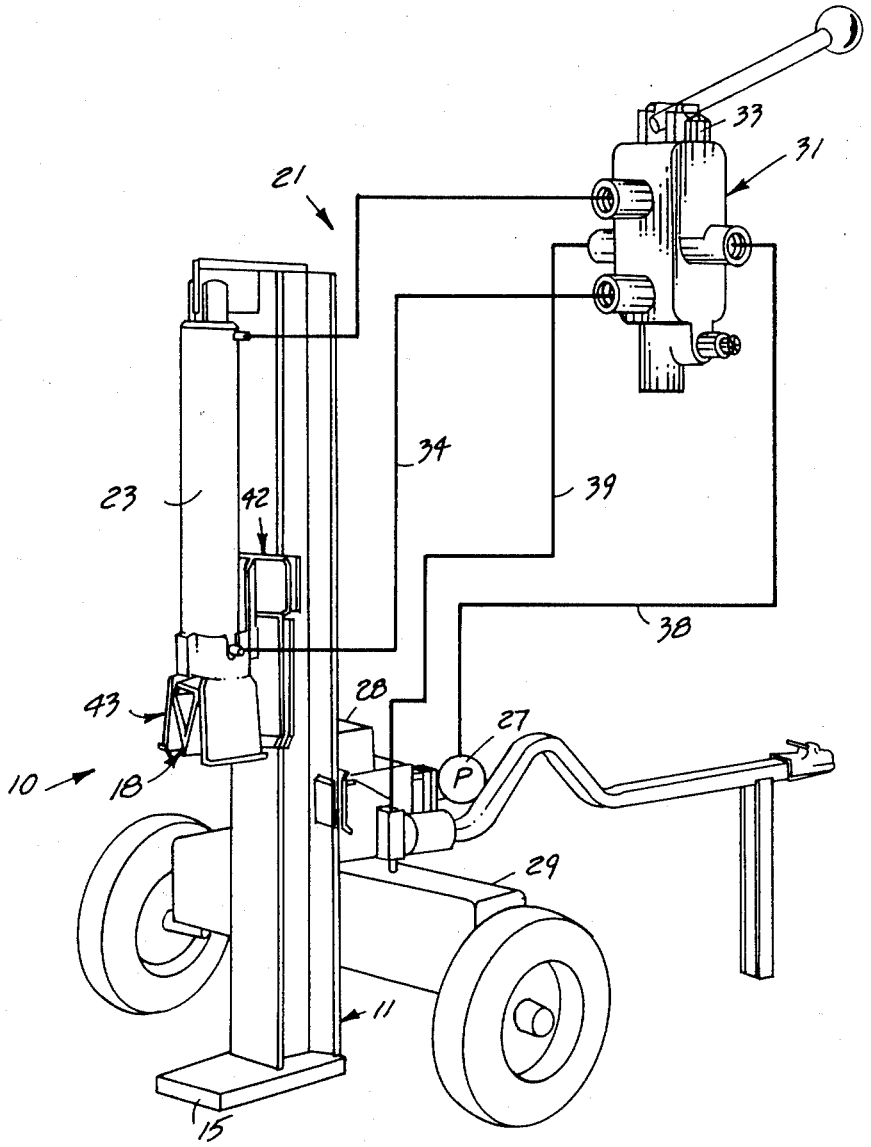
FIG. 5 is a schematic view illustrating a hydraulic circuit and valve arrangement useful with the present stripper and stroke stop attachment.

A manually operable valve 31 is provided in the hydraulic system as an operating means for selectively controlling extension and contraction of the cylinder piston shaft 24 and blade 18. It is preferred that the valve include an adjustable pressure relief means 32 (FIG. 5) that is selectively operable to deactivate the cylinder on its return stroke responsive to a prescribed pressure buildup within a cylinder retraction line 34. The valve 31 includes an overall primary pressure relief 33 for connection between the feed line 38 from pump 27 and the return line 39 to avoid excessive pressure buildup in the entire hydraulic system. Relief means 32 operates at a selected pressure (preferably about 1400 psi) within the return stroke hydraulic line 34 to move the valve to a neutral position, routing the hydraulic fluid back through line 39 to stop the stroke of the cylinder.

A conventional manually operable hydraulic spool valve, the LS3000-1 or LS3000-2 valve produced by Prince Manufacturing of Sioux City, Iowa includes pressure reliefs 32, 33 suitable for purpose disclosed herein. The "Prince" valve also includes provisions enabling the user to manually override the relief valve means 32 up to the overall pressure limitation set by the primary pressure relief 33 (preferably about 2500 psi).

The present invention includes a stop means 42 adjustably mounted to the frame 11 and a stripper means 43, mounted to the stop means 42. The entire stop 42 and stripper 43 assembly can be selectively mounted to or removed from the frame. It is therefore possible that stop means 42 and stripper means 43 may be manufactured and sold as an attachment for existing splitters having hydraulic systems and blade arrangements similar to that discussed herein.

The stop means 42 is preferably comprised of a clamp base 45 and a pair of clamp plates 46. The base 45 and plates 46 are mounted together by bolt and nut tighteners 49 or similar securing devices that will selectively operate to securely clamp the base and plates 46 together, securing them immovably on the frame 11. Knurled surfaces 48 are provided on the example shown on the clamp plates 46 to enhance the secure gripping action of the clamp against the frame in order to selectively secure the stop means in place at selected positions along the frame 11. A slide plate abutment surface 47 is provided at a bottom edge of the clamp base for engagement with the top surface 20 of the blade slide plate 19.

The stripper means 43 is mounted to the stop means 42 by a stripper mount 51. The mount 51 is welded or otherwise secured to the clamp base 45 and extends toward the wood support 15 when mounted to the frame 11.

In the example shown, the stripper mount 51 extends to an end mounting a split housing 53. The assembled housing is shaped to loosely receive the bottom end of the hydraulic cylinder 23 as illustrated in FIG. 1. The housing is also shaped to loosely receive the splitting blade 18 axially therein.

The housing 53 includes opposed longitudinal halves or sides 55 that may be bolted together and to the mount 51. The sides 55 extend down to stripping surfaces 56. These surfaces are situated axially adjacent the cutting edge 22 of the splitting blade 18 when the blade is fully retracted to its starting position. The stripping surfaces 56 are engaged by wood blocks that may be bound on the splitting blade as the blade is retracted to its starting position. An alternate form of the stripper means may simply comprise one or more rigid "L" shaped members (not shown) secured to the stop means and extending to opposite sides of the blade 18. Other forms of the stripper means may also be envisioned without departing from the scope of the present invention.

It is important to note the distance between the slide plate abutment surface 47 and the stripping surfaces 56. This distance is approximately equal to a corresponding distance between a top slide edge 20 of the blade support slide 19 and the cutting edge 22 of the blade. With this relationship, the blade must be retracted into the housing 53 before the slide plate abutment surface 47 is engaged. The stripping surfaces will therefore strip bound wood from the blade 18 as the blade approaches its selected starting position.

Operation of the present invention may commence with mounting of the stop and stripper means 42, 43 to the frame 11. This is accomplished simply by positioning the clamp base 45 on the longitudinal surface of the frame 11 adjacent the cylinder 23. Next the clamp plates 46 are secured in position, loosely engaging the frame 11 on a side opposite the clamp base 45. The housing sides 55 are then assembled over the cylinder shaft 24 and secured to the stripper mount 51.

The assembly (means 42, 43) can be mounted to the splitter as shown in FIG. 1 so the blade 18 may be fully retracted. This is accomplished simply by axially sliding the housing 53 loosely over the bottom end of the cylinder prior to securing the bolt-nut tighteners 49.

If it is desired to reduce the stroke length to the wood support 15, the stop means can be moved along the frame to selectively reposition the starting position for the blade. This is done firstly by positioning the blade 18 at the desired new starting position. Next the bolt-nut tighteners 49 are loosened and the stop and stripper means 42, 43 are moved along the frame until the slide plate abutment surface 47 comes into contact with the top edge 20 of the newly positioned blade slide plate 19. The bolt-nut tighteners 49 may then be secured to tightly clamp the stop means 42 in position on the frame. This adjustment automatically positions the stripper means 43 for operation at the newly selected blade starting position.

The location of stop means 42 and stripper means 43 along the frame 11 determines the new starting position of the blade 18. A block of wood may now be placed between the newly positioned blade and the wood support 15. Next, the valve 31 is manually actuated to cause extension of the cylinder piston shaft 24, thereby moving the blade from the new starting position toward the support 15. The cutting edge of the blade will engage the top surface of the wood block and, with the force of the cylinder, will drive its way through the block. After the wood splits, the operator may shift the valve manually to retract the blade 18. As this happens, the slide plate 19 will move along the frame 11 until the top edge 20 contacts the slide plate abutment surface 47. The now stationary abutment surface 47 will stop further retraction of the slide plate and blade. This causes a build-up of pressure within the cylinder retraction hydraulic line 34 causing the pressure relief 32 to operate, resetting the valve 31 to its neutral of "off" position.

If the wood does not fully split, the stripper means 42 will function on the return stroke to remove the bound wood from the blade. This happens as a function of the return stroke when the blade pulls the partially split wood into engagement with the stripping surfaces 56. The surfaces 56 are stationary and will therefore hold the wood as the blade retracts further. The blade will continue to retract from the block and withdraw into the confines of the housing 53 at the new starting position.

Typically, resistance between the partially split wood engaging the stripping surfaces 56 and the retracting blade will not be sufficient to elevate pressure within the hydraulic line 34 beyond that required for operation of the pressure relief 32 (1400 psi). However, should such an occurrence arise, the operator may manually override the relief 32 to facilitate application of the full power retraction of the blade to its beginning position. This action is allowable within the overall system pressure parameters set by the master system pressure relief 33 (2500 psi).

Once the wood is stripped from the blade, the operator can release the valve to its normal operating mode and the pressure relief 32 will operate again to stop retraction of the blade as it reaches its new starting position. However, should the operator inadvertently hold the valve in the override position, the master pressure relief 33 will operate to relieve excessive pressure buildup beyond a selected safe limit, and simply divert flow from the pump 27 back to the reservoir 29.

Interconnection of the stripper means 43 and stop means 42 facilitates selection of the stroke starting point for the blade 18 and at the same time automatically adjusts the splitter for stripping wood at the selected starting position along the frame. This is a distinct advantage over known forms of stop mechanisms and stripping mechanisms that are separate in adjustment, and in operation. That is, stroke limiting apparatus in the past has operated independently of any stripping mechanisms except at the full stroke retracted position of the blade. The current arrangement, on the other hand, will provide both stroke limiting features and wood stripping capability at any selected position along the splitter frame within the total effective stroke of the blade.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A wood splitter, comprising:

an elongated frame having a wood support surface thereon;

a splitting blade having a cutting edge;

drive means on the frame end connected to the splitting blade for selectively moving the splitting blade from a starting position through a splitting stroke toward the wood support platform, and a retraction stroke, away from the wood support surface to the starting position;

stop means adjustably mounted to the frame for selectively locating the starting position of the splitting blade along the frame; and stripper means on the stop means for engaging and stripping wood from the splitting blade as the splitting blade is retracted to the starting position.

2. The wood splitter of claim 1 wherein the stop means is comprised of:

clamp means selectively operable to be secured to the frame at a selected position along the length thereof;

abutment means on the clamp means for operatively engaging the splitting blade to stop retraction of the splitting blade at the selectively located starting position.

3. The wood splitter of claim 2 wherein the stripper means is comprised of:

a tripping surface; and wherein the stripping surface is located on a hollow housing means mounted to the clamp means for releasably receiving the splitting blade at the selectively located starting position and for locating the stripping surface adjacent to the cutting edge of the blade at the selectively located starting position.

4. The wood splitter of claim 1 wherein the stripper means is comprised of:

a stripping surface on the stop means adjacent to the splitter blade when in the selectively located starting position.

5. The wood splitter of claim 1 further comprising operating means connected to the drive means for selectively deactuating the drive means, responsive to operative engagement of the splitting blade against the stop means on the retraction stroke.

6. The wood splitter of claim 5 wherein the stop means is comprised of:

clamp means selectively operable to be secured to the frame at a selected position along the length thereof;

abutment means on the clamp means for operatively engaging the splitting blade to stop retraction of the splitting blade at the selectively located starting position.

7. The wood splitter of claim 6 wherein the stripper means is comprised of:

hollow housing means mounted to the clamp means for releasably receiving the splitting blade at the starting position; and a stripping surface on the hollow housing adjacent the cutting edge of the splitting blade in the selectively located starting position thereof.

8. The wood splitter of claim 5 wherein the stripper means is comprised of:

a stripping surface mounted to the stop means adjacent to the splitter blade at the selectively located starting position thereof.

9. The wood splitter of claim 5 wherein the drive means includes a hydraulic cylinder with a piston shaft connected to the splitting blade and a driven pump for supplying hydraulic fluid to the cylinder; and wherein the operating means is comprised of a manually actuatable valve connected in a hydraulic circuit to the hydraulic cylinder and the driven pump, selectively operable to cause the cylinder to extend and retract the piston shaft and splitting blade; and pressure relief means within the valve for deactuating the drive means responsive to a selected pressure build-up within the hydraulic circuit as the retracting splitting blade operatively engages the stop means.

10. A stripping and stroke limiting attachment for a wood splitter having an elongated frame with a wood support thereon and a splitting blade driven from a starting position along the frame toward and away from the wood support, the attachment comprising:

a clamp selectively operable to be secured at selected positions along the elongated frame;

a stop surface on the clamp for operative abutment with the splitting blade to selectively adjust the starting position of the splitting blade to a selected starting location along the length of the elongated frame; and a stripping surface on the clamp for engaging and stripping wood from the splitting blade as the splitting blade is moved to the selected location.

* * * * *